United States Patent [19]

Olszewski

[11] 4,433,990

[45] Feb. 28, 1984

[54] PROCESS TO RECOVER ARGON FROM OXYGEN-ONLY AIR SEPARATION PLANT

[75] Inventor: Walter J. Olszewski, Tonawanda, N.Y.

[73] Assignee: Union Carbide Corporation, Danbury, Conn.

[21] Appl. No.: 328,631

[22] Filed: Dec. 8, 1981

[51] Int. Cl.[3] ..... F25J 3/02

[52] U.S. Cl. ..... 62/22; 62/28; 62/29; 62/33; 62/34; 62/39; 62/42

[58] Field of Search ..... 62/22, 23, 24, 25, 26, 62/27, 28, 29, 30, 31, 32, 33, 34, 42, 43, 38, 39

[56] References Cited

U.S. PATENT DOCUMENTS

| | | | |
|---|---|---|---|
| 1,638,005 | 8/1927 | Le Rouge | 62/22 |
| 1,880,981 | 7/1930 | Pollitzer et al. . | |
| 2,545,462 | 3/1948 | Haynes | 62/175.5 |
| 2,547,177 | 11/1948 | Simpson | 62/175.5 |
| 2,700,282 | 2/1949 | Roberts | 62/175.5 |
| 2,728,205 | 6/1950 | Becker et al. | 62/122 |
| 3,729,943 | 5/1973 | Petit | 62/22 |
| 4,057,407 | 11/1977 | Bigi | 62/22 |
| 4,137,056 | 1/1979 | Golovko | 62/13 |

*Primary Examiner*—Frank Sever

*Attorney, Agent, or Firm*—Stanley Ktorides

[57] ABSTRACT

A process and apparatus to economically produce argon in conjunction with an air separation plant designed originally to produce only oxygen wherein an auxiliary argon column is fed with a small stream from the main oxygen plant and is driven by an independent heat pump circuit.

13 Claims, 9 Drawing Figures

PROCESS TO RECOVER ARGON FROM OXYGEN-ONLY AIR SEPARATION PLANT

DESCRIPTION

1. Technical Field

This invention relates generally to the field of cryogenic air separation and more particularly to the production of argon from the cryogenic separation of air.

2. Background Art

Argon is a highly useful inert gas which in the past has been used for many applications such as in lightbulbs, for welding of metals, and for various other metallurgical uses. Approximately one percent of atmospheric air is argon. Argon is produced commercially in cryogenic air separation plants which also produce oxygen and nitrogen. Recently the demand for argon has increased dramatically due primarily to the use of argon in the refining of stainless and other steels.

In the past, many air separation plants were built for the steel industry to supply oxygen for steel making. These plants were often adjacent to the steel making operations and were designed especially for that operation. Since argon demand was not high, many such old air separation plants were built without any capability to recover argon. These air separation plants are a potential source of argon. However, conversion of an air separation plant which was not built to recover argon into one that can recover argon has been difficult to accomplish primarily because the column arrangements of such non-argon plants and modern argon producing plants are quite different. Conversion of an existing oxygen-only air separation plant to one having argon capability would involve substantial equipment modification and cost.

Furthermore, in order to economically retrofit such oxygen-only plants to also produce argon requires that several other criteria be met. First, the additional argon recovery system should be such that production outage of the existing plant is minimized during installation of the argon recovery equipment. Second, the retrofit recovery system should be such that it produces crude argon product compatible with existing argon refining equipment. Third, the retrofit system should not substantially detract from operation of the existing air plant. It is also desirable that the additional argon producing system recover a high percentage of the available argon.

Consequently, it is an object of this invention to provide an improved argon recovery process compatible with existing non-argon cryogenic air separation plants.

It is another object of this invention to provide a retrofit argon recovery process that minimizes existing air separation plant production outage during installation of the argon recovery equipment.

It is another object of this invention to provide an argon recovery process capable of recovering a high percentage of the available argon.

It is a further object of this invention to provide an improved process which produces crude argon product compatible with existing argon refining systems.

It is a further object of this invention to provide a retrofit argon recovery process that does not substantially degrade the oxygen recovery of an existing air separation plant.

DISCLOSURE OF THE INVENTION

The above and other objects which will be readily apparent to those skilled in the art are accomplished by this invention, one aspect of which comprises:

In a process for producing oxygen by the separation of air wherein feed air is introduced to an oxygen production facility comprising a high pressure column in heat exchange relation with a low pressure column wherein vapor and liquid flow countercurrently and contact to effect the separation the improvement comprising:

(A) withdrawing from the low pressure column a stream having a flow rate of from about 3 to 9 percent of that of the feed air, said stream comprising from about 10 to 18 percent argon, at most about 0.5 percent nitrogen and the remainder primarily oxygen;

(B) introducing said stream as feed into an argon column having a top condenser and a bottom condenser and which is driven by an independent heat pump circuit comprising the steps of:

(1) introducing cooled, compressed heat pump fluid as vapor to a heat exchanger where it is cooled to a high pressure cold condition, (2) introducing said high pressure cold vapor to said bottom condenser where it is condensed to a liquid, (3) expanding the liquid heat pump fluid and introducing it to the top condenser where it is vaporized, and, (4) withdrawing the heat pump fluid as vapor from the argon column and introducing it to said heat exchanger of step (1) where it is warmed;

(C) separating said feed in said argon column by rectification into an argon-rich fraction and an oxygen-rich fraction;

(D) withdrawing from said argon column at least a portion of said argon-rich fraction as product crude argon containing at least 96 mole percent argon; and (E) withdrawing at least a portion of said oxygen-rich fraction as product oxygen having an oxygen concentration of at least 99 mole percent.

In another aspect this invention comprises:

In an apparatus for producing oxygen by the separation of air comprising a high pressure column in heat exchange relation with a low pressure column, the improvement comprising:

(A) a column for producing argon connected to said low pressure column by conduit means and having a top condenser and a bottom condenser;

(B) means to compress a heat pump fluid;

(C) heat exchanger means to cool said compressed heat pump fluid before it is introduced to said bottom condenser where it is liquefied;

(D) means to transfer the liquid heat pump fluid to said top condenser where it is vaporized; and (E) means to transfer the vaporous heat pump fluid to said heat exchanger means where it is warmed.

The term, column, is used to mean a distillation or fractionation column, ie., a contacting column or zone wherein liquid and vapor phases are countercurrently contacted to effect separation of a fluid mixture, as, for example, by contacting of the vapor and liquid phases on a series of vertically spaced trays or plates mounted within the column, or alternatively on packing elements with which the column is filled. For an expanded discussion of the foregoing, see the Chemical Engineer's Handbook, Fifth Edition, edited by R.H. Perry and C.H. Chilton, McGraw-Hill Book Company, New York, Section 13, "Distillation" B.D. Smith et al., page 13-3, *The Continuous Distillation Process.*

The term, double column, is used to mean a higher pressure column having its upper end in heat exchange relation with the lower end of a low pressure column. Examples of a double column appear in Ruheman "The Separation of Gases", University Press, 1949.

The term, heat pump circuit, is used to mean a recirculating fluid arrangement whereby heat is removed at a lower temperature and added at a higher temperature. Usually the heat pump arrangement involves vaporization of the recirculating fluid (or working medium) to remove heat, and condensation of the fluid to add heat.

DETAILED DESCRIPTION

Figure 1:
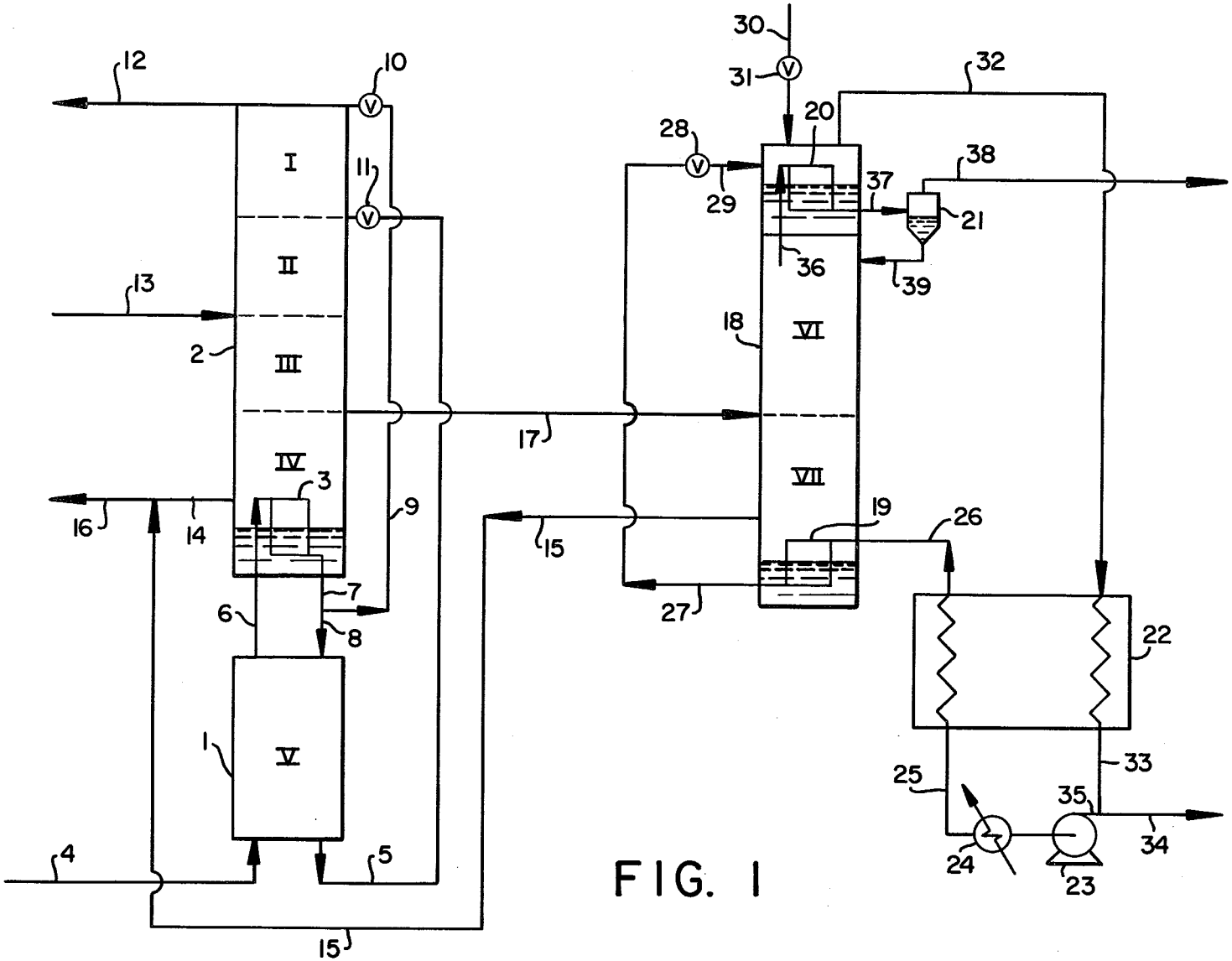
FIG. 1 is a schematic flow diagram illustrating a preferred embodiment of the present invention.

This invention provides a process and apparatus for producing argon by modification of existing cryogenic air separation processes and apparatus which produce oxygen, and which permits economic recovery of argon. The process and apparatus of this invention produce argon at a purity of at least 96 mole percent thus allowing its relatively easy employment in existing argon refineries. The process and apparatus of this invention also produce oxygen at a purity of at least 99 mole percent thus allowing its direct intermixture with the product from the existing oxygen-only plant.

The improved process of this invention employs an auxiliary two-section crude argon column driven by an independent heat pump cycle. The column feed is taken from an intermediate point within the existing air separation plant low pressure column and is essentially an argon-oxygen mixture with minimal nitrogen content. This feed stream is separated within the argon column into two product streams. One product stream, taken from the bottom of the argon column is a product oxygen stream at a composition similar to that of the product oxygen stream taken from the main air separation plant low pressure column. The other product steam is a crude argon product at a composition compatible with existing argon refining systems.

The argon column system can include a refrigeration source which can, for example, be either added liquid nitrogen in the top condenser of the argon column or other appropriate point in the heat pump circuit or it can be liquid oxygen in the bottom condenser of the column, or, refrigeration may be provided by a turbine expansion of part of the circulating fluid in the heat pump circuit. The refrigeration source and means by which it is supplied to the argon column system is an engineering judgment well within the competence of one skilled in this art and will depend, inter alia, on equipment availability and the liquid supply availability.

The feed in the argon column is taken from the main air separation plant low pressure column at a point above the bottom or product oxygen location. The feed quantity transferred to the argon column will range from 3 to 9 volume percent of the feed to the main air separation plant or oxygen production facility, preferably from 5 to 7 percent. The feed stream is taken from the low pressure column at a point such that its composition is from 10 to 18 percent, preferably from 12 to 16 percent argon. The nitrogen content of the feed stream should not exceed 0.5 percent and preferably does not exceed 0.2 percent. The balance of the feed stream is composed primarily of oxygen.

In order to satisfactorily drive the argon column and to obtain suitable purity for both the crude argon and oxygen products, the heat pump flow circuit circulates 3 to 7 times the feedstream flow rate, preferably from 4 to 5 times the flow rate. Any suitable fluid may be used as the heat pump fluid including nitrogen, oxygen, argon, crude argon mixture or clean and dry air. The preferred heat pump fluid is nitrogen.

The improved process of this invention is further described with reference to the drawings. FIG. 1 illustrates a preferred embodiment of the process and apparatus of this invention. Only the columns section of the existing oxygen-only air separation plant is illustrated since all other sections such as the heat exchangers and associated warm end equipment do not influence the process and apparatus combination of this invention. However, all process sections of the add-on argon recovery process and apparatus are shown in order to fully explain the arrangement. For the main air separation plant there is shown a high pressure column 1 combined with a low pressure column 2 and an interconnecting condenser unit 3. A feed air stream 4 enters the column section at high pressure at the bottom of the high pressure column. This high pressure air is preseparated in the lower column tray section V into a shelf liquid 9 and a kettle liquid 5. The vapor 6 rising from the top of column section V is condensed in the condenser unit 3 into liquid stream 7. This liquid stream is then divided so that a portion 8 is used as reflux for the high pressure column whereas the remaining portion 9 is used as reflux for the top of the low pressure column. These liquid streams that transfer from the high pressure column to the low pressure column can be subcooled by existing streams but this process detail is not illustrated. Reflux stream 9 is expanded through valve 10 into the top of the upper column whereas reflux stream 5 is expanded through valve 11 several trays lower. The two liquid streams and a low pressure air stream 13 commonly referred to as turbine air fraction since it is used for air separation plant refrigeration, enter the low pressure column and are separated into a product stream 14 and a waste stream 12. The additions to the main column include the withdrawal of stream 17 from the upper column and the return of stream 15 to the product oxygen. These two streams are required to convert the existing non-argon producing plant to an argon producing plant via the process and apparatus of the invention. Feed stream 17 is a stream containing relatively high argon content with almost all of the remaining component being oxygen. Only a small part of stream 17 is nitrogen. The return stream 15 is a vapor product oxygen quality stream so that it can be combined with 14 to form the combined plant product oxygen stream 16 which has product oxygen specifications normally suited for direct use.

Turning now to the auxiliary column portion of the system, the feed stream 17 from the low pressure column of the main plant enters the midpoint of an auxiliary column 18. The primarily argon-oxygen feed stream 17 is separated into two product quality streams. The first stream is taken from the bottom of the auxiliary column and is of a purity such that it can be added to the product oxygen of the main plant. This stream 15 is thereby returned to the main oxygen plant at a point downstream of product oxygen withdrawal from the existing low pressure column. The other product stream 38 is the crude argon product. This product stream contains substantially all the argon present in feedstream 17 along with substantially all of the minor nitrogen content of that stream and some minimal oxygen content. The crude argon product stream has purity specifications comparable to those normally obtained from a conventioanl argon production air separation plant.

The manner of driving the auxiliary crude argon column to effect the separation of feedstream 17 can be better understood by describing the heat pump circuit. Suitable fluid, such as nitrogen, is compressed by compressor 23 at ambient temperature and then passed to water cooler 24 to return the high pressure stream to ambient conditions as stream 25. This stream is cooled by heat exchanger 22 to a high pressure cold condition as stream 26. That stream passes into condenser 19 at the bottom of the argon column where it is condensed by giving up its heat of condensation and thereby vaporizing liquid oxygen at the bottom of the column. This condensing-boiling action serves to form vapor reflux for the bottom of the crude argon column. The high pressure liquid stream 27 is expanded in valve 28 and then passes into a top reflux condenser via conduit 29. Within this reflux condenser the liquid is evaporated and leaves that condenser via conduit 32 so that it can enter heat exchanger 22 to be rewarmed to a low pressure ambient condition as stream 33. The condenser 20 which is placed within the low pressure chamber at the top of the argon column is used to condense column vapor 36 from the top of the crude argon column which then passes through conduit 37 to liquid-vapor separator 21. This separator has the function of retaining the liquid and passing it through conduit 39 as reflux to the top of the crude argon column whereas the remaining vapor is removed through conduit 38 as crude argon product. The particular arrangement shown for the top condenser 20 and associated liquid vapor separator 21 is a desirable one for this application because it prevents buildup of the non-condensible nitrogen within the condenser. The flow circuit shown tends to remove that nitrogen with the crude argon product stream 38. However, though this illustrated arrangement is desirable, it is not necessary. The crude argon product 38 could be removed as a portion of the rising column vapor stream 36. The remaining portion would then be completely condensed in condensor 20 and returned as reflux liquid to the separation column. As noted before, low pressure ambient stream as at 33 can then be compressed by compressor 23 and thereby supply the necessary heat and refrigeration to drive the crude argon column. This heat pump circuit is capable of supplying heat at the bottom and refrigeration at the top of the column but basically does not supply refrigeration which may be needed to sustain the overall system at a low operating temperature level. This function of sustaining the system at low operating temperature levels can be accomplished by adding liquid such as at 30 (and if necessary through valve 31 depending on condenser pressure levels). The liquid added to the top condenser will vaporize as determined by heat influx from the atmosphere and the vapor will then combine with fluid entering through conduit 29 to exit conduit 32. Dependent on the fluid leakage of the associated equipment and the heat leak for the associated equipment, some of the liquid fluid added can be vented by an appropriate control as shown by conduit 34. This arrangement of venting excess fluid from the enclosed circuit via a warm end vent is advantageous in that all of the available refrigeration from the liquid, i.e. both latent and sensible heat, is utilized to maintain the system at the cold operating temperature level. The system shown as FIG. 1 shows all the essential elements for the process and apparatus of this invention and as will be shown later, it has advantages of minimizing existing air separation plant product outage, maximizing crude argon product recovery, and desirable stable operation.

Figure 2:
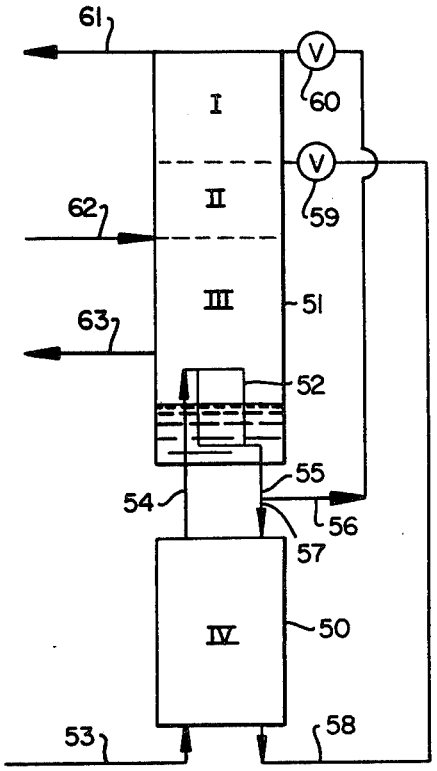
FIG. 2 (PRIOR ART)
FIG. 2 is a schematic flow diagram illustrating the column arrangement of a conventional oxygen-only cryogenic air separation plant.

In order to fully appreciate the benefits of the improved process of this invention, it is helpful to describe a conventional oxygen-only plant column configuration and compare it to a conventional oxygen-argon plant column configuration. FIG. 2 illustrates a conventional oxygen-only plant column section. The plant is composed of a high pressure column 50 combined with a low pressure column 51. The two columns are joined by main condenser 52. The high pressure air enters the lower column at 53 and is separated into a high nitrogen content vapor stream 54 and a high oxygen content stream 58. Stream 54 is condensed in condenser 52 and exits that unit as a liquid stream 55. That liquid stream is split into two portions. One portion 57 is used as reflux for the high pressure column whereas the other portion 56 is transferred to the top of the low pressure column after expansion through valve 60. The high oxygen content fraction 58 is expanded through valve 59 at a lower point in the low pressure column. At a still lower point, low pressure air 62 is fed to the upper column. This low pressure air 62 is fed to the upper column. This low pressure air 62 or turbine air fraction is that fraction of the feed air which is turbine expanded within the heat exchanger portion of the plant to develop refrigeration for the air plant. All three feeds in the low pressure column, the two liquid feeds and the one vapor are separated into two streams. The one stream 63 becomes the product oxygen stream and is drawn from the bottom of the low pressure column whereas the other stream 61 is then the waste stream and is taken from the top of the column. Heat exchangers (not shown) may subcool the liquid reflux streams between the high pressure and low pressure columns. As shown, the column configuration is for an oxygen-only type air separation plant, that is, the intended product of the plant is gas oxygen at a high purity as normally required for industrial operations. It can be seen that this column section arrangement uses three sections for the upper column I, II and III and one section for the lower column IV.

Figure 3:
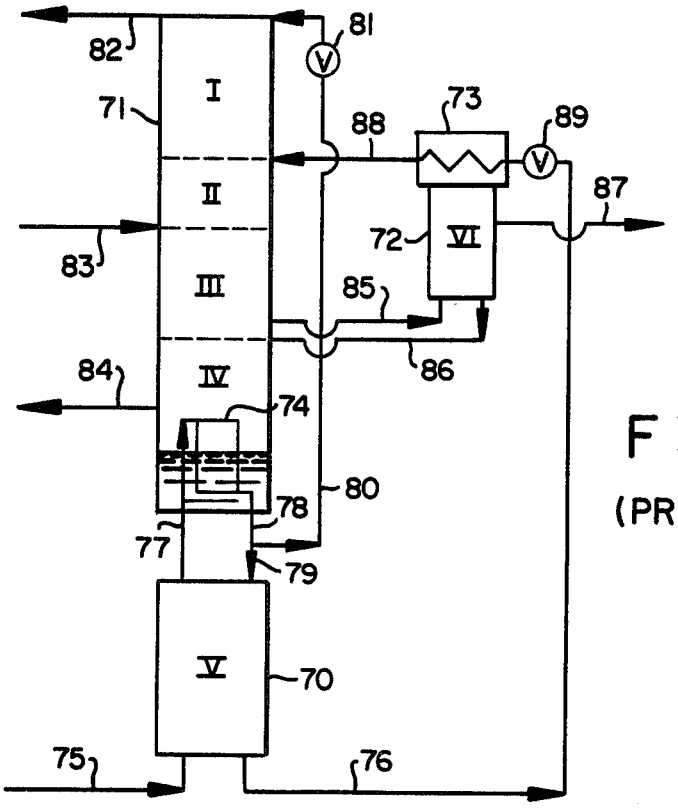
FIG. 3 (PRIOR ART)
FIG. 3 is a schematic flow diagram illustrating the column arrangement for a conventional oxygen-argon plant where the argon recovery feature was designed and constructed from the inception of the plant.

A conventional column arrangement utilized for an oxygen and argon producing air separation plant is illustrated in FIG. 3. As can be seen from FIG. 3, this arrangement employs a high pressure column 70 combined with a low pressure column 71 and joined by a condenser unit 74. The addition required to produce an argon product is a crude argon column 72. The high pressure air 75 enters the bottom of the lower column and progresses through a tray section so that high nitrogen content vapor stream 77 enters heat exchanger 74 and exits as condensed liquid 78. The condensed liquid stream is split into two portions, one returned as reflux 79 for the high pressure column whereas the other 80 is transferred as reflux to the top of the low pressure column. Although the high nitrogen content reflux stream is expanded through valve 81 into the top of the upper column as for the oxygen-only plant, the high oxygen reflux stream from the bottom of the high pressuree column is transferred to condenser 73 at the top of the crude argon column. It is expanded through valve 89 and partially evaporated in condenser 73 prior to being introduced into the low pressure column as stream 88 as a liquid and vapor mixture. The low pressure column has a low pressure air feed 83 which is that fraction of the air utilized for plant refrigeration. However, the low pressure column is modified compared to the oxygen-only situation in that it has two additional feed points between that low pressure air stream 83 and the product oxygen stream 84. At an intermediate point, a vapor feed stream 85 is drawn from the low pressure column and fed to the bottom of the crude argon column 72 where it is enriched to high argon content at the top of the column 72. At the top of that column, some of this vapor is condensed in the unit 73 to serve as reflux for the column whereas the remaining fraction of the vapor is drawn as a crude argon product 87. The reflux stream continues down the bottom of the column 72 and is then re-introduced to the low pressure column as stream 86. On an overall combined basis, the system produces a product oxygen stream 84 from the low pressure column, a crude argon product 87 from the argon column and a waste stream 82 from the top of the low pressure column. It can be seen that this arrangement requires a four section low pressure column, I, II, III and IV and a one section high pressure column V in addition to another single section VI argon column. This conventional oxygen-argon column configuration allows separation of the air feed into oxygen and argon products employing only internal process streams and is an effective separation system.

Comparing the conventional oxygen-only column configuration to the conventional oxygen-argon column configuration, it can be seen that the column arrangement for the two systems is quite different. As will be shown later, the additional feed streams connecting the argon column with the main air separation plant do not make it attractive to convert the oxygen-only column configuration to the conventional oxygen-argon column configuration.

Figure 4:
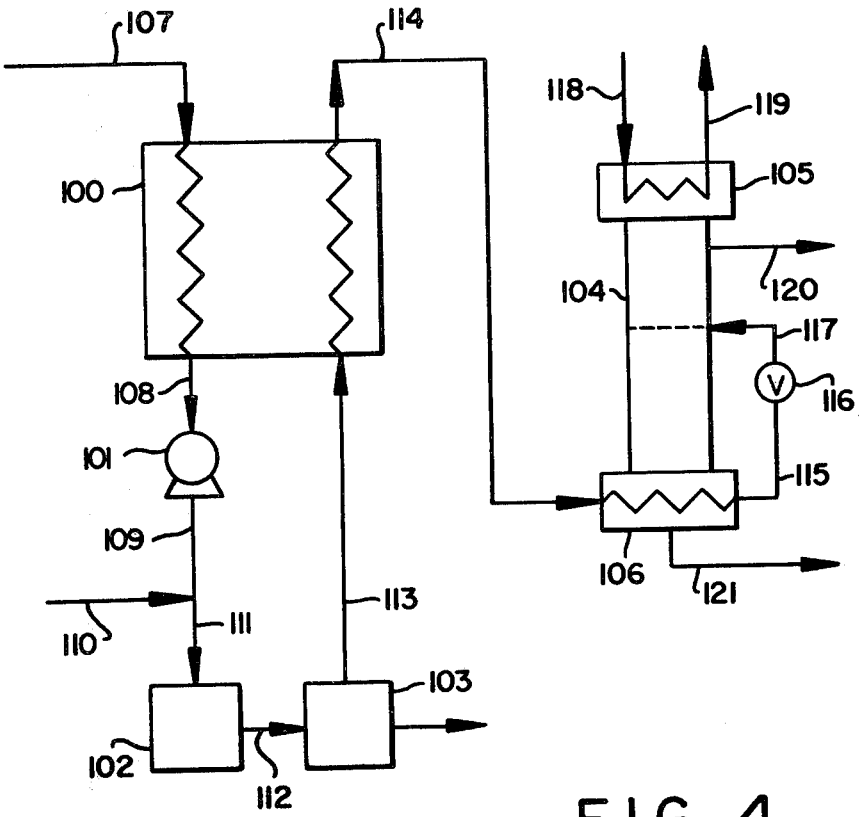
FIG. 4 (PRIOR ART)
FIG. 4 is a schematic flow diagram illustrating the process arrangement for a conventional argon refinery.

The crude argon product 87 produced from the conventional oxygen-argon column arrangement can be refined as illustrated in FIG. 4. As shown, the crude argon stream 107 is warmed in exchanger 100 to an ambient temperature low pressure condition as at 108. This low pressure vapor is then compressed by compressor 101 and cooled by water cooler (not shown) so that it is in a high pressure ambient condition at 109. At this point, small hydrogen stream 110 is added and the combined hydrogen crude product stream 111 is introduced into a catalytic reactor 102. In this reactor, the hydrogen and oxygen content of the crude argon product is reacted so that existing stream 112 contains no free oxygen but is instead moisture containing. That moisture is then removed in drier 103 so that stream 113 contains only argon and nitrogen (and perhaps some excess hydrogen). That stream is then cooled in exchanger 100 so that the cold high pressure stream 114 is then condensed in condenser 106 and the liquid 115 is expanded through valve 116 and passed through conduit 117 as feed to a nitrogen rejection column 104. This column is refrigerated at the top by liquid nitrogen 118 which is transferred in condenser 105 to cold nitrogen gas 119. The combination of the argon nitrogen stream condensing at the bottom of the column 104 and the liquid nitrogen refrigeration at the top serves to drive the column so that the nitrogen is rejected at 120 and liquid argon at high purity can be removed at the bottom of the column as stream 121.

Figure 5:
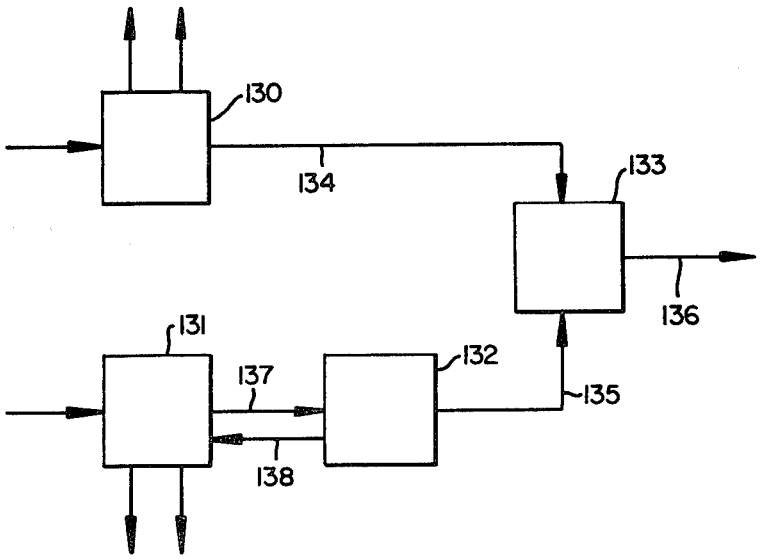
FIG. 5 is a schematic flow diagram illustrating the retrofit argon recovery process of the present invention in a multiplant facility.

At least two benefits of the process and apparatus of this invention are illustrated schematically in FIG. 5. This figure shows the addition of the auxiliary column argon recovery process and apparatus of this invention at a plant location that combines an existing oxygen-only air separation plant 131 and existing oxygen-argon air separation plant 130. The capability of the auxiliary column system of this invention to produce crude argon 135 at essentially the same purity specifications as the conventional argon plant allows a central or common argon refinery for both plants. Hence, the crude argon 135 from the auxiliary column can be combined with the crude argon 134 from the oxygen-argon plant and processed in a common argon refinery 133 to produce refined argon 136 product. This feature of the auxiliary argon recovery process is attractive in that it allows the use of a conventional argon refining system or allows the use of existing argon refinery as may already be available with an exisitng oxygen-argon plant at the same location wherein an oxygen-only plant is to be coverted to recover argon. Another advantage of the improved process of this invention is illustrated schematically in FIG. 5. As shown, the only two streams joining the main existing oxygen-only plant 131 and the auxiliary argon column 132 are the feed stream 137 and the oxygen product return stream 138. This feature of minimal process stream connection between the existing oxygen-only plant and the auxiliary argon recovery unit is an extremely convenient feature of this invention. Since the stream connections are minimal, it is possible to build the retrofit auxiliary column equipment in a separate casing adjacent the existing plant while it continues operation. The main oxygen-only air separation plant need be shut down for only the relatively short time required to make the two stream connections. Hence, this feature has the major economic advantage of reducing existing main air separation plant production outage during construction of the retrofit argon recovery unit. This can be appreciated further when one compares the column arrangement of FIGS. 2 and 3. It can be seen that converting an oxygen-only column configuration to the conventional oxygen-argon column configuration would involve major modification of the main separating column and hence involve considerable plant production outage.

Figure 6A:
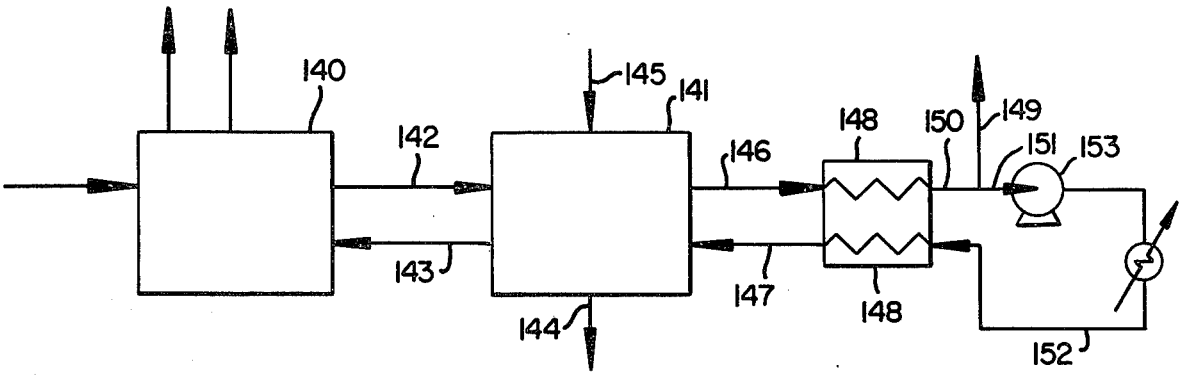
FIG. 6 is a schematic flow diagram illustrating several refrigeration options for the process of this invention.

Additional flexibility of the auxiliary argon column process is illustrated schematically in FIG. 6. This figure shows that the retrofit argon recovery process has considerable flexibility relative to refrigeration source. The process arrangement shown on FIG. 6A utilizes liquid nitrogen for refrigeration of the argon column. As shown, the main air separation plant 140 is connected to the auxiliary column feed stream 142 and return oxygen stream 143. The liquid nitrogen refrigerant 145 is added to the top condenser of the auxiliary column and is returned with stream 146 through exchanger 148. The warm nitrogen stream 150 includes the nitrogen in the heat pump circuit and that due to the liquid nitrogen refrigerant addition. In order to maintain pressure conditions, nitrogen could be vented as at 149 with the remaining nitrogen 151 being compressed by compressor 153 and then returned at high pressure as stream 152. That stream is cooled and enters as cold high pressure nitrogen 147 which comprises the nitrogen flow required to drive the auxiliary column. The auxiliary argon column produces a crude argon stream 144 suitable for further processing in a conventional argon refining system. The nitrogen vent 149 is dependent on the relationship between the liquid nitrogen refrigeration needed and the leakage of associated argon recovery equipment. Since all practical equipment does have some loss of fluid when pressurized, it would be expected that stream 149 to be vented would be somewhat less than the refrigerant stream 145 added to the auxiliary system. Although addition of the liquid nitrogen to the top condenser is preferred practice, it is acceptable to add the liquid at another point. For example, actual process piping restrictions may make it desirable to add the liquid between the top condenser and the heat pump recycle heat exchanger.

Figure 6B:
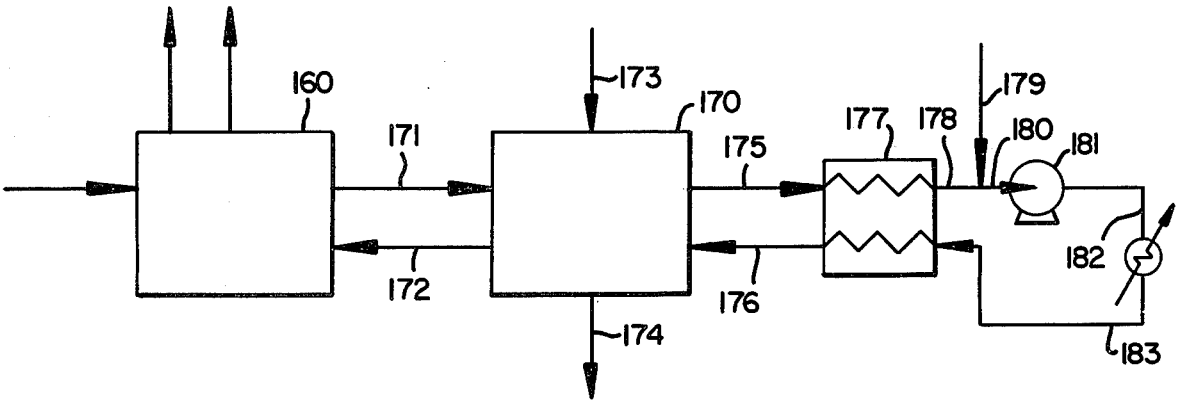

Another option relative to refrigeration for the auxiliary argon column unit is illustrated schematically in FIG. 6B. This illustration shows the main plant 160 connected to auxiliary argon column 170 by feed stream 171 and oxygen return stream 172. For this process modification, the argon column is refrigerated by the addition of liquid oxygen 173 to the bottom condenser of the auxiliary argon column. This liquid when vaporized to counteract the heat leakage then returns as oxygen product stream 172. The auxiliary argon column produces crude argon 174 suitable for further processing. The oxygen return 172 is the sum of that obtained from the feed stream 171 and the vaporized refrigerant stream 173. Accordingly, the heat pump circuit including exchanger 177 and compressor 181 includes cold nitrogen vapor 175 exiting from the column warmed in the exchanger to warm condition 178. Then nitrogen make-up 179 is added so that combined stream 180 is compressed to the high-pressure, high-temperature condition 182. Following the water cooler, the high pressure ambient temperature stream 183 is then cooled to high pressure cold condition 176 entering the condenser of the auxiliary argon column. Nitrogen makeup 179 would be required to counterbalance equipment leakage within the nitrogen heat pump circuit. The nitrogen make-up stream 179 would be required to counterbalance equipment leakage within the nitrogen heat pump circuit. The nitrogen make-up stream 179 can be obtained from any convenient source, such as a pressurized nitrogen pipeline within the plant complex, or as part of any available nitrogen stream from the main air separation plant.

Figure 6C:
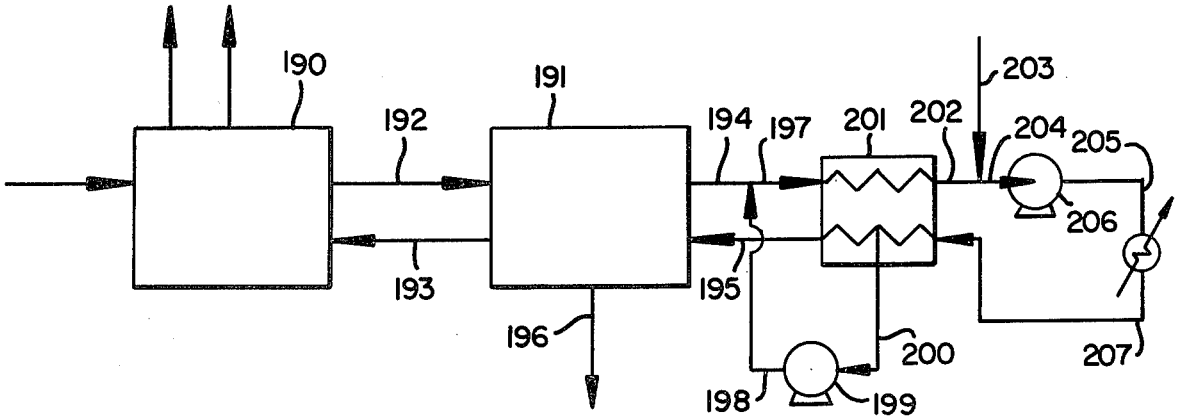

FIG. 6C schematically shows still another refrigeration option for the auxiliary argon column. Main plant 190 is connected to auxiliary argon column 191 by feed stream 192 and oxygen return stream 193. The crude argon 196 is sent for further processing in a conventional argon refining system. This refrigeration option does not use liquid addition to the auxiliary argon column; instead it uses a turbine expansion of circulating fluid incorporated with the heat pump loop. Nitrogen is compressed by compressor 205 to yield a high pressure, high temperature nitrogen stream 206 which is cooled in a water cooler to a high pressure ambient condition as in 207. This stream is partially cooled in exchanger 201 and then a portion of that stream 200 is removed from the exchanger and expanded 199 to produce a low temperature stream 198. The remaining high pressure nitrogen stream is cooled and enters as stream 195 to the condenser of the auxiliary argon column. Within the column this stream drives the bottom boiler and top condenser and exits as a low pressure cold stream 194. The cold stream from the expander is added to this stream and the combined stream 197 is then rewarmed in exchanger 201 to ambient temperature 202. Nitrogen make-up stream 203 is added to counterbalance equipment leakage losses and then the combined low pressure stream 204 is passed to the compressor for another circuit. The system refrigeration is produced by the turbine expansion of stream 200 and necessary refrigeration for the column is transferred to the column by refrigeration exchange between streams 197 and 195, that is, stream 195 is cooled further than it would be if stream 198 were not added to the return nitrogen stream.

Dependent on the liquid refrigeration supply situation and turbine expansion equipment availability, any of the three options is a suitable means of refrigerating the auxiliary argon column and the choice is within the competence of one skilled in this art.

Figure 7:
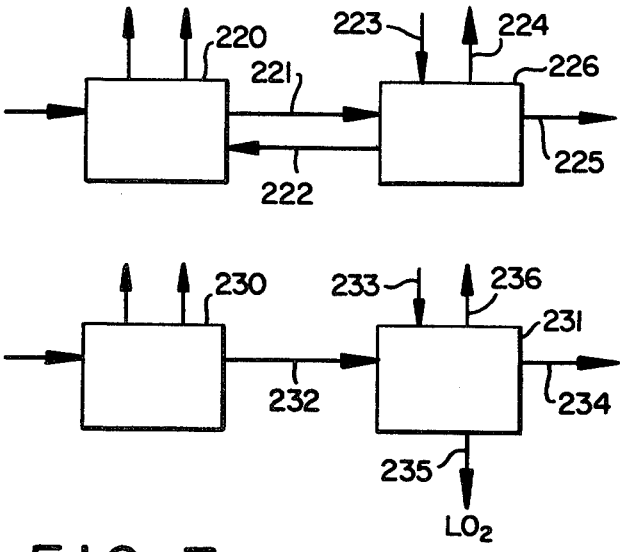
FIG. 7 is a schematic flow diagram illustrating two feed stream options for the process of this invention.

The flexibility of the improved process of this invention relative to the feed condition is illustrated schematically in FIG. 7. The preferred arrangement utilizes the combination of the main air separation plant 220 and the auxiliary argon column 226 connected by vapor feed 221 and a vapor oxygen return stream 222. The argon column can use refrigerant stream 223 and involve a vent nitrogen stream 224 and a crude argon product 225. It is possible for the argon column to utilize a liquid feed. As illustrated, main plant 230 is combined with argon column 231 via liquid feed 232. This liquid feed has a similar compositon as the gas feed but would then be separated into a liquid oxygen fraction 235 and a crude argon fraction 234 which may or may not be liquid depending on the addition of liquid nitrogen refrigerant 233. The crude argon fraction could be produced as liquid if sufficient liquid nitrogen refrigerant 233 and thereby vent gas 236 were added. However, it would be possible to produce a vapor crude argon fraction 234 by corresponding reduction of liquid nitrogen 233 addition. The liquid feed connection illustrated would apply in that situation where the main oxygen-only plant was normally a liquid oxygen producer. Hence, this would mean that the additional feed stream transferred to the add-on argon package would be liquid also and would not upset the refrigeration balance of the main air separation plant.

The advantages of the process and apparatus of this invention can be illustrated by comparing its performance to a conventional argon column process and an additional argon column system available in the prior art. The conventional column configuration for an air separation plant producing oxygen and argon products has been described as shown in FIG. 3. U.S. Pat. No. 1,880,091, Pollitzer et al., teaches the use of an additional argon column to separate a feed stream from the low pressure column of the main air separation plant.

For a typical air plant processing about two million cu. ft. of air per hour (56,600 $m^3$/hr) a conventional system requires an argon column feed of about 442,000 cfh (12,509 $m^3$/hr) to produce the crude argon product. The argon product typically contains about 97.5% argon and about 1½% oxygen and 1% nitrogen. The argon product purity specifications are such that the crude product can be readily upgraded to refined product in a conventional argon refinery. For the system employing the process and apparatus of this invention the argon column feed is about 114,000 cfh (3226 $m^3$/hr) for similar air feed, or only about ¼ of that required in the conventional arrangement. The auxiliary column can produce 98,400 cfh (2785 $m^3$/hr) of oxygen product at required purity of 99.5% oxygen and a crude argon product of 15,600 cfh (442 $m^3$/hr). Argon product purity conditions are essentially the same as that of the conventional argon column. Further, the oxygen and argon recovery is comparable to the conventional plant. Hence, it can be seen that addition of the auxiliary argon column to the existing oxygen-only air plant by use of the teachings of this invention results in a combined performance equivalent to that available by utilizing a conventional oxygen-argon plant configuration. As previously discussed, this performance is available without the disadvantages related to converting the oxygen-only column configuration to the conventional oxygen-argon column configuration.

The Pollitzer et al. additional argon column as driven by the high pressure column nitrogen vapor also processes a feed stream taken from the low pressure column of the main plant. This stream of again about 114,000 cfh (3226 $m^3$/hr) is in a liquid condition and results in producing about 103,700 cfh (2935 $m^3$/hr) of liquid oxygen product from the auxiliary column and about 10,300 cfh (292 $m^3$/hr) of vapor crude argon product. The crude argon product purity may be marginally acceptable for further processing in a conventional refining system, although the nitrogen content of 3.8% would tax the nitrogen rejection section of the refinery. Any attempt to reduce the lower column vapor draw for the auxiliary column, and thereby slightly increase plant oxygen recovery, would cause very significant increase of nitrogen and oxygen impurity in the crude argon product. Such crude argon product probably could not be processed in a conventional refining system, due to excessive hydrogen (for oxygen removal) and liquid nitrogen (for nitrogen removal) requirements. On an overall basis, the use of the high pressure column is a serious drawback to the performance of both the auxiliary column and the main air separation plant in that the plant argon recovery for the system is only 53% and further the plant oxygen recovery drops to only about 83%.

A comparison of a computer simulation of the performance of a system employing this invention with that of a known additional argon column system i.e., that of Pollitzer et al., is presented in Table I.

TABLE I

ARGON RECOVERY SYSTEM COMPARISON

| | Argon Recovery System of This Invention | Pollitzer Additional Argon Column |
|---|---|---|
| Column Refrigeration/ | Nitrogen Heat Pump | High Pressure Column $N_2$ Vapor |

TABLE I-continued

ARGON RECOVERY SYSTEM COMPARISON

| | Argon Recovery System of This Invention | Pollitzer Additional Argon Column |
|---|---|---|
| Column Trays | 70 | 70 |
| Column Feed Condition | Vapor | Liquid |
| Column Feed Flow cfh (NTP) ($m^3$/hr) | 114,000 (3226) | 114,000 (3226) |
| Column Oxygen Product cfh (NTP) at 99.5% $O_2$ ($m^3$/hr) | 98,400 (2785) | 103,700 (2935) |
| Column Argon Product cfh (NTP) $m^3$/hr) | 15,600 (442) | 10,300 (292) |
| Argon Product Purity | | |
| Argon % | 97.5 | 95.3 |
| Oxygen % | 1.3 | 0.9 |
| Nitrogen % | 1.2 | 3.8 |
| Plant Argon Recovery % | 82 | 53 |
| Plant Oxygen Recovery % | 99 | 83 |

Another advantage of the auxiliary argon column process is illustrated in Table II. This table summarizes a computer simulation of the performance of a conventional oxygen-argon plant and one employing the process and apparatus of this invention for equivalent plant upsets. The table tabulates the expected purities for feed and product streams associated with the argon column for the two processes as a function of liquid reflux changes. The base case is the situation expected with steady plant operation. The two other cases labeled 1% reflux decrease and 1% reflux increase illustrate the situation related to plant operating variations due to either normal plant changes or unexpected changes. For example, conventional air plants often utilize reversing heat exchangers for contaminant removal and thereby periodically reverse flow in the heat exchangers which causes a flow upset for the columns. Additionally, there may be fluctuations related to adjustments of expansion turbine streams or gel trap replacment again associated with normal plant operation. Dependent on the severity of these plant upsets, whether caused by normal operating procedures or unexpected operating changes, argon column purities will change and sometimes cause crude argon products to fail to meet specification and thereby require venting of crude argon product with the obvious loss of that product. Hence, it is desirable that a system be stable under plant upsets, to insure that the argon recovery system can continue operation.

TABLE II

ARGON RECOVERY PROCESS STABILITY COMPARISON

| Process Condition | 1% Reflux Decrease | Base Case | 1% Reflux Increase |
|---|---|---|---|
| Conventional Argon Column | | | |
| Oxygen Product | | | |
| Purity, % $O_2$ | 99.20 | 99.5 | 99.54 |
| Crude Argon Product | | | |
| Purity, % $O_2$ | 0.54 | 1.40 | 1.65 |
| Ar | 83.03 | 97.58 | 98.19 |
| $N_2$ | 16.43 | 1.02 | 0.16 |
| Argon Recovery System of This Invention | | | |
| Main Column Oxygen Product | | | |
| Flow$_3$ cfh ($m^3$/hr) | 320,660 (9075) | 320,660 | 320,660 |
| Purity, % $O_2$ | 99.78 | 99.50 | 99.52 |

TABLE II-continued

| ARGON RECOVERY PROCESS STABILITY COMPARISON | | | |
|---|---|---|---|
| Process Condition | 1% Reflux Decrease | Base Case | 1% Reflux Increase |
| Auxiliary Argon Column Feed | | | |
| Flow cfh ($m^3$/hr) | 115,400 (3266) | 115,400 | 115,400 |
| Purity, % $O_2$ | 86.50 | 86.50 | 86.50 |
| Ar | 13.28 | 13.38 | 13.47 |
| $N_2$ | 0.21 | 0.11 | 0.08 |
| Auxiliary Column Oxygen Product | | | |
| Flow cfh ($m^3$/hr) | 100,000 (2830) | 100,000 | 100,000 |
| Purity, % $O_2$ | 99.52 | 99.52 | 99.49 |
| Crude Argon Product | | | |
| Flow cfh ($m^3$/hr) | 15,400 (436) | 15,400 | 15,400 |
| Purity, % $O_2$ | 1.0 | 1.73 | 1.48 |
| Ar | 96.72 | 97.41 | 97.92 |
| $N_2$ | 1.58 | 0.86 | 0.59 |

As can be seen from an examination of Table II, showing the argon recovery process stability comparison, equivalent plant upsets for the conventional system and auxiliary column system result in improved stability for the auxiliary argon column system. Thus, whereas a 1% reflux decrease for the conventional argon column results in nitrogen content of 16% in the crude argon product which would require venting of the argon product, for the auxiliary column system of this invention the nitrogen content under similar upset increases to only about 1.6%. This percentage level of nitrogen in the crude argon product would allow continued production of crude argon product with retention of product. It is believed that the use of the nitrogen heat pump loop to drive the argon column combined with the reduction in vapor transfer between the upper column and the auxiliary column serve to dampen column upset variations. Accordingly, the auxiliary argon column process and apparatus of this invention has the significant advantage of minimizing purity variations around the system as a function of plant operational upsets and thereby is expected to be able to remain in production under conditions where the conventional column would need to stop operation.

It should be noted that the known additional argon column system of Pollitzer would be expected to undergo the same instability as that shown for the conventional argon column, since that system is driven by process streams associated with the main air plant. Hence, the auxiliary argon column process and apparatus of this invention has the advantages of comparable product recovery relative to a conventional argon plant, improved stability of operation, flexibility at existing plant locations, and ease of plant retrofits. The auxiliary argon column process and apparatus of this invention is a significant advance for argon retrofit systems.

I claim:

1. In an existing process for producing oxygen by the separation of air wherein feed air is introduced to an oxygen production facility comprising a high pressure column in heat exchange relation with a low pressure column wherein vapor and liquid flow countercurrently and contact to effect the separation, the improvement comprising retrofitting said existing process to include argon recovery capability including the steps of:

(A) withdrawing from the low pressure column a stream having a flow rate of from about 3 to 9 percent of that of the feed air, said stream comprising from about 10 to 18 percent argon, at most about 0.5 percent nitrogen and the remainder primarily oxygen;

(B) introducing said stream as feed into an argon column having a top condenser and a bottom condenser and which is driven by an independent heat pump circuit comprising the steps of:

(1) introducing cooled, compressed heat pump fluid as vapor to a heat exchanger where it is cooled to a high pressure cold condition, (2) introducing said high pressure cold vapor to said bottom condenser where it is condensed to a liquid, (3) expanding the liquid heat pump fluid and introducing it to the top condenser where it is vaporized, and, (4) withdrawing the heat pump fluid as vapor from the argon column and introducing it to said heat exchanger of step (1) where it is warmed;

(C) separating said feed in said argon column by rectification into an argon-rich fraction and an oxygen-rich fraction;

(D) withdrawing from said argon column at least a portion of said argon-rich fraction as product crude argon containing at least 96 mole percent argon; and (E) withdrawing at least a portion of said oxygen-rich fraction as product oxygen having an oxygen concentration of at least 99 mole percent.

2. The process of claim 1 wherein the argon column vapor is partially condensed in the top condenser and separated into a liquid portion and a vapor portion, and wherein said liquid portion is returned to the argon column as reflux.

3. The process of claim 1 wherein both the feed stream into the argon column and the product streams from the argon column are vapor streams.

4. The process of claim 1 wherein said heat pump circuit additionally comprises the addition of refrigeration.

5. The process of claim 4 wherein said refrigeration is supplied by the addition of liquid nitrogen.

6. The process of claim 5 wherein the feed stream to the argon column and the oxygen product stream are vapor streams, and the argon product stream is a liquid stream.

7. The process of claim 5 wherein said refrigeration is supplied by the addition of liquid nitrogen to the top condenser.

8. The process of claim 4 wherein said added refrigeration is supplied by turbine expansion of the circulating heat pump fluid.

9. The process of claim 4 wherein said refrigeration is supplied by the addition of liquid oxygen to the bottom condenser.

10. The process of claim 1 wherein said heat pump fluid is nitrogen.

11. The process of claim 1 wherein said stream comprises 5 to 7 percent of said feed air.

12. The process of claim 1 wherein said stream comprises from about 12 to 16 percent argon.

13. The process of claim 1 wherein said stream comprises less than 0.2 percent nitrogen.

* * * * *